United States Patent [19]

Clemenson et al.

[11] 4,243,110

[45] Jan. 6, 1981

[54] PNEUMATIC PERCUSSION DRILL WITH EXHAUST COOLING AND LUBRICATION OF CHUCK END

[75] Inventors: James T. Clemenson, Littleton; Robert R. Vincent, Denver, both of Colo.

[73] Assignee: Cooper Industries, Inc., Houston, Tex.

[21] Appl. No.: 10,438

[22] Filed: Feb. 8, 1979

[51] Int. Cl.[3] ..... B25D 15/00; B25D 17/22

[52] U.S. Cl. ..... 173/104; 173/76; 173/DIG. 2; 181/230

[58] Field of Search ..... 173/75, 104, 111, 116, 173/134, DIG. 2, DIG. 3, 76, 112, 128, 73, 80, 59; 74/467, 468; 175/17; 181/230

[56] References Cited

U.S. PATENT DOCUMENTS

| | | | |
|---|---|---|---|
| 2,452,268 | 10/1948 | Schumann | 173/75 |
| 3,376,939 | 4/1968 | Holzapfel | 173/116 |
| 3,635,299 | 1/1972 | Hayes | 173/DIG. 2 |
| 3,785,248 | 1/1974 | Bailey | 173/DIG. 2 |

*Primary Examiner*—Werner H. Schroeder
*Attorney, Agent, or Firm*—Michael E. Martin

[57] ABSTRACT

A pneumatic percussion rock drill includes a muffler casing surrounding the drill cylinder part and sealingly engaged with the drill housing so that exhaust air from the percussion motor flows forward through ports in a forward housing member into a chamber containing the drill chuck, the chuck rotation gearing, and the drill stem shank. Exhaust air is used to cool and lubricate the chuck parts before exiting from the drill onto the feed mechanism located below the drill housing.

6 Claims, 3 Drawing Figures

PNEUMATIC PERCUSSION DRILL WITH EXHAUST COOLING AND LUBRICATION OF CHUCK END

BACKGROUND OF THE INVENTION

The present invention pertains to pneumatic percussion drills of the type in which a drill stem has an impact receiving member which is disposed in blow-receiving relationship with the percussion hammer and the drill includes mechanism for rotating the impact receiving member.

In the art of percussion rock drills and the like the impact receiving member, commonly known as the shank, is supported in a rotatable chuck in a position to be struck by repeated blows of an impact piston hammer. The chuck is mounted in the forward part of the drill housing and is subjected to mechanical and thermal stresses imposed thereon due to the high frequency blows transmitted from the piston hammer through the shank and due to the high thrust forces caused by the forward feeding force transmitted through the chuck to the drill stem.

Not only are the chuck parts and the shank subjected to high stresses but the location of the chuck in the forward part of the drill housing exposes the chuck parts to the drill cuttings being ejected from the drill hole particularly when the drill is in close proximity to the workface or when drilling is being carried out in an upward direction. It is particularly difficult to effectively seal the chuck end from entry of drill cuttings because the shank extends through the end of the housing and undergoes continuous rotary and oscillatory movement during operation of the drill.

It has been proposed to provide lubrication and cooling of the chuck housing and parts by introducing pressure air from the drill motor supply source. Pressurizing the chuck housing with motive air at supply pressure also substantially prevents entry of drill cuttings into the chuck housing. However, this method of treating the chuck end of the drill is somewhat inefficient since high pressure motive air is used directly only for cooling, lubrication, and sealing purposes.

SUMMARY OF THE INVENTION

The present invention provides improved means for cooling and lubricating the chuck end of a pneumatic percussion rock drill or the like wherein the exhaust fluid from the percussion drill motor is conducted to and through the chuck end of the drill to cool and lubricate the chuck parts.

In accordance with the present invention a pneumatic percussion rock drill is provided with a muffler casing disposed around and sealingly engaged with the drill housing to form a primary muffler chamber for exhaust air exiting from the drill percussion motor. The exhaust air flows from the primary muffler chamber to a secondary muffler chamber comprising the interior of the chuck housing of the drill and finally exits the chuck end housing and flows over the drill feed mechanism. Accordingly, the chuck housing not only serves as a muffling chamber for the exhaust air from the drill percussion motor, but the exhaust air cools and lubricates the chuck end parts of the drill including the shank, the chuck rotation gearing, and the bearings supporting the chuck.

DESCRIPTION OF THE PREFERRED EMBODIMENT

Figure 1:
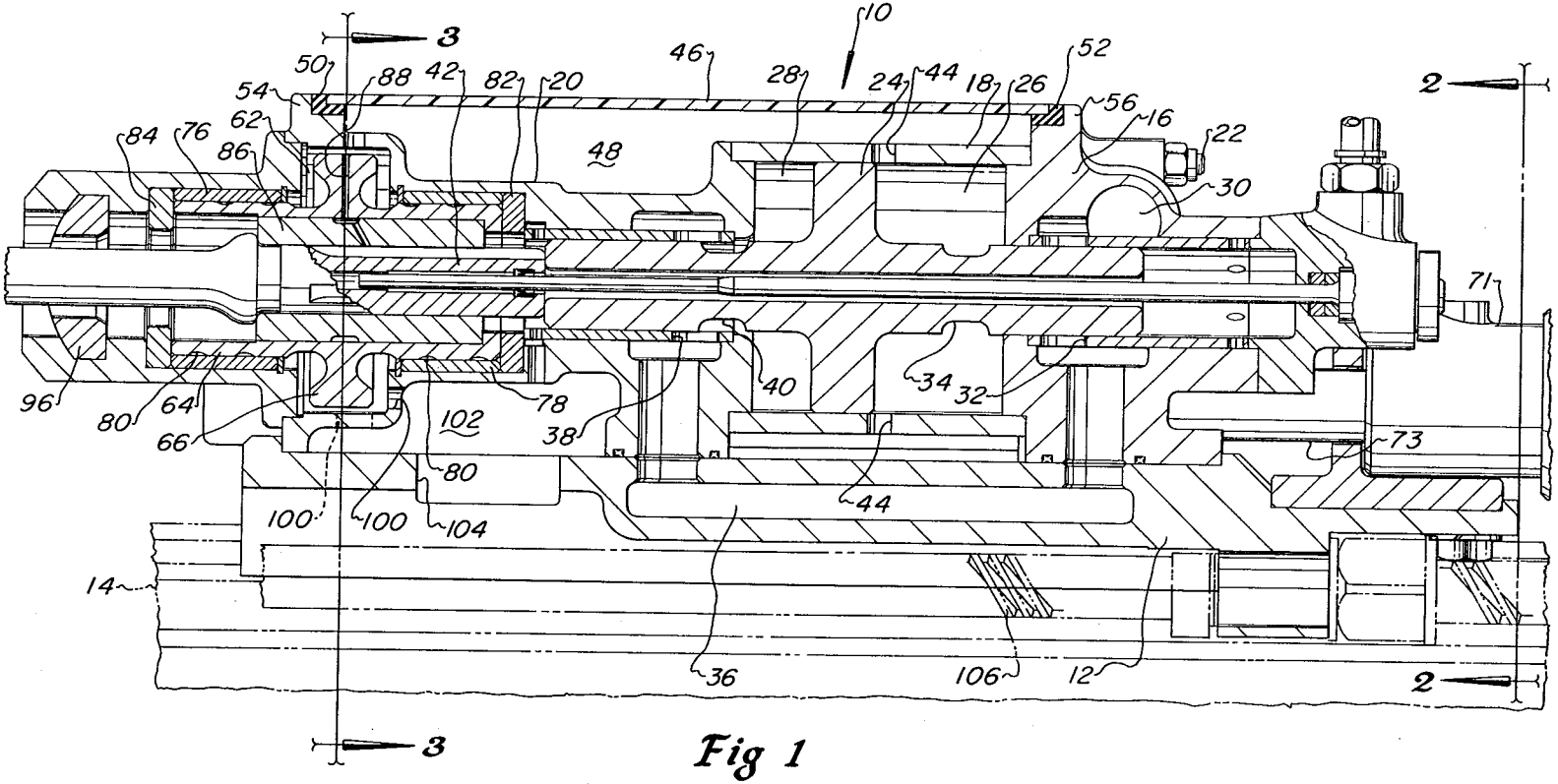
FIG. 1 is a logitudinal central section view of a pneumatic percussion rock drill in accordance with the present invention.
Figure 3:
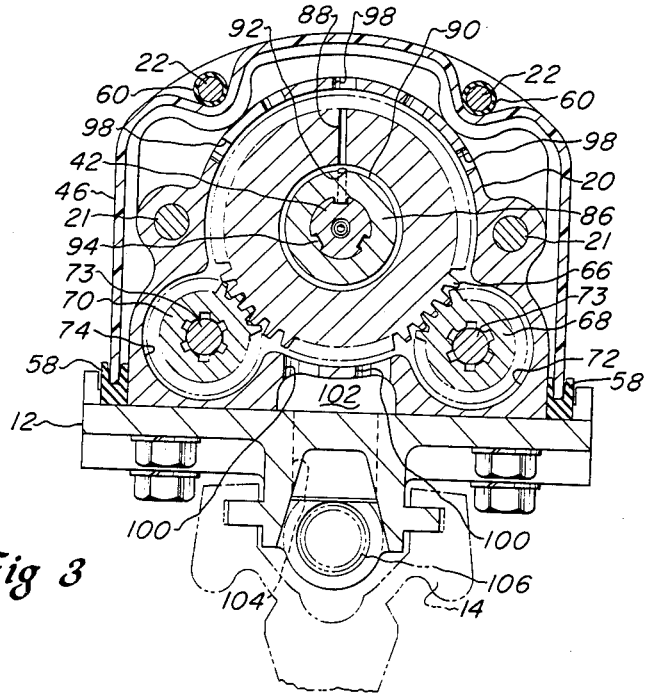

Referring to FIGS. 1 and 3 of the drawings, a pneumatic percussion rock drill in accordance with the present invention is shown and generally designated by the numeral 10. The drill 10 includes a base member 12 which is adapted to be slidably mounted on an elongated feed bar 14. The drill 10 also includes a percussion motor housing defined by a backhead member 16, a cylinder part 18 and a forward housing member 20. The members 16 and 20 and the cylinder part 18 are held in assembly by elongated bolts 21, FIG. 3. A piston hammer 24 is reciprocably disposed in the percussion motor housing and divides the interior of the cylinder part 18 into opposed expansible chambers 26 and 28. Pressure air is admitted to the chamber 26 by way of an inlet passage 30, ports 32, and an annular groove 34 on the piston hammer 24. Pressure air is conducted to the chamber 28 by way of passage 36, ports 38, and a groove 40 on the hammer 24. The operation of the piston hammer 24 to deliver repeated impact blows to a blow-receiving member comprising a drill stem shank 42 is believed to be well known to those skilled in the art of pneumatic percussion rock drills and will not be described further herein.

The cylinder part 18 includes exhaust ports 44 disposed so as to vent the chambers 26 and 28 as the piston hammer 24 reciprocates therewithin. The drill 10 also includes a muffler casing 46 disposed around the percussion motor housing and defining a primary expansion and muffling chamber 48 for the flow of exhaust air exiting from the ports 44. The muffler casing 46 is preferably formed of a thermoplastic material or aluminum and is mounted in suitable resilient gaskets 50 and 52 on respective flanges 54 and 56 of the housing members to minimize transmission of acoustic vibration between the percussion motor housing and the casing and to seal the joints therebetween. The casing 46 is also sealingly engaged with a gasket 58 disposed between the longitudinal side edges of the casing and the base member 12. The casing 46 is retained in its assembled relationship with the percussion motor housing by elongated bolts 22, shown in FIG. 3, which extend between the flanges 54 and 56. The bolts 22 are covered by a suitable resilient coating or sheath 60 to minimize the transmission of machine vibrations to the casing 46.

Figure 2:
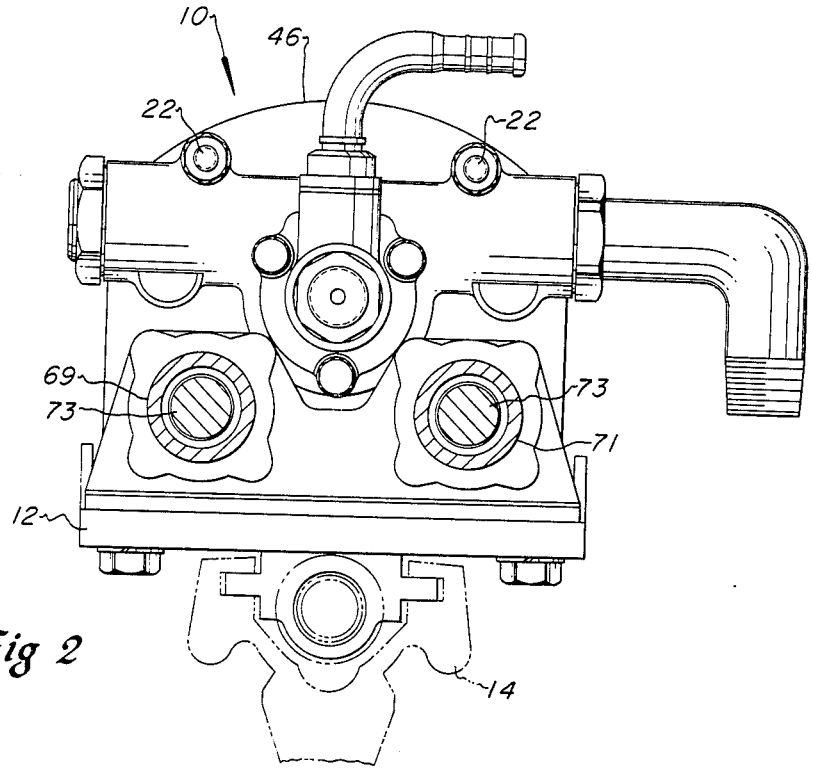
FIG. 2 is an elevation of the back end of the drill taken from line 2—2 of FIG. 1; and, FIG. 3 is a section view taken along the line 3—3 of FIG. 1.

Referring again to FIGS. 1 and 3 the forward housing member 20 includes an interior chamber 62 in which is mounted a rotatable chuck 64. The chuck 64 includes an integral gear 66 which is meshed with a pair of drive pinions 68 and 70, FIG. 3, disposed in respective cavities 72 and 74 formed in the housing member 20. The pinions 68 and 70 are adapted to be rotatably driven by respective fluid operated motors 69 and 71, FIG. 2, mounted on the rearward end of the base member 12 and interconnected to the pinions by suitable drive shafts 73. The chuck 64 is rotatably mounted in suitable sleeve bearings 76 and 78 disposed in the housing member 20. The bearing journals of the chuck 64 may be provided with spiral grooves 80 to facilitate the distribution of lubricant and coolant along the bearings 76 and 78. The chuck 64 is also engageable with a thrust bearing 82 disposed in the housing member 20 for supporting the chuck against the axial thrust force caused by the forward feeding of the drill along the feed bar 14. A reverse thrust bearing 84 is provided at the opposite end of the chuck 64. The chuck 64 includes a liner 86 which is adapted to support the shank 42 nonrotatably with respect to the chuck.

The chuck 64 also includes a passageway 88, which is in communication with a groove 90 and a passage 92 in the liner 86 for conducting lubricating and cooling fluid from the chamber 62 into the bore of the liner to lubricate the interengaged surfaces of the shank 42 and the liner. The shank 42 and the liner 86 are preferably formed to have interfitting splines 94 to provide for rotatably driving the shank. The shank 42 is retained in the chuck 64 for limited axial sliding movement with respect to the chuck by a transversely slidable retainer 96.

The forward housing member 20 includes a plurality of exhaust fluid inlet ports 98 disposed above the gear 66. The housing member 20 also includes a plurality of outlet ports 100 disposed on its lower side generally opposite the inlet ports 98. The inlet ports 98 place the chamber 48 in communication with the interior chamber 62 of the forward housing member whereby the exhaust air flow from the drill percussion motor flows into the expansion and muffling chamber 48 and then serially into and through the chamber 62 and finally exiting through the ports 100 into yet a third chamber 102 formed by the housing member 20 and the base member 12. The exhaust air then exits through an opening 104 in the base member 104 directly onto the feed mechanism which typically may be a chain, hydraulic cylinder, or a power screw 106, as shown.

It is conventional practice in the art of pneumatic percussion rock drills to inject a mist of lubricating oil into the motive air supply upstream of the drill proper. Lubricant injection devices of the general type disclosed in U.S. Pat. No. 3,135,356, assigned to the assignee of the present invention, may be inserted in the motive air supply conduit leading to the drill percussion motor. That lubricant which does not become disposited on the sliding surfaces of the piston hammer and its supporting bearings is carried out through the exhaust ports of the percussion motor. Accordingly, with the arrangement of the present invention a great portion of the lubricant still entrained in the motive air as it is exhausted from the ports 44 is carried into the chamber 62 by the air flow wherein the gear 66 and drive pinions 68 and 70 are lubricated as well as the journal and thrust bearings. Moreover, the exhaust air flowing into the chamber 62 is at a relatively low temperature due to expansion and serves to cool the shank 42 and the chuck 64. These latter two parts are subjected to high thermal stress due to the transmission of percussive energy therethrough.

In the operation of the drill 10 a substantially continuous flow of relatively low temperature (0° C. to −20° C.) air with lubricant entrained therein flows into the chamber 48 from the cylinder part 18 and then into the chamber 62 where it cools and lubricates the chuck working parts. The cavities 72 and 74 trap lubricant drops which collect on the sidewalls of the chamber 62 and aid in lubrication of the pinions 68 and 70. The exhaust air, with whatever lubricant remains entrained therewith flows out through chamber 102 and bathes the feed mechanism to aid in keeping the same clean and lubricated.

The chambers 48, 62 and 102 also serve to attenuate noise generated by the exhaust air stream and the exhaust air performs multiple functions as it flows through the chamber 102 and onto the feed mechanism below the drill itself. Moreover, the pressure in the chamber 62 is usually slightly greater than the ambient air pressure outside the drill and some of the exhaust air may exit the chamber 62 through the front end of the housing member 20 past the thrust collar 82. This outflow of exhaust air while the drill 10 is operating reduces the tendency for drill cuttings and other debris to enter the enterior of the front housing member 20.

What is claimed is:

1. In a pneumatic percussion drill adapted to be connected to a source of motive air:

a housing including a cylinder bore;

a piston hammer disposed in said cylinder bore and forming opposed chambers in said cylinder bore;

exhaust ports opening into said cylinder bore for conducting exhaust air from said chambers;

a forward part of said housing including an interior chamber;

chuck means rotatably disposed in said interior chamber and drivably engaged with a drill stem shank;

inlet and exit ports opening into said interior chamber; and means for conducting exhaust air from said exhaust ports to said interior chamber by way of said inlet ports whereby exhaust air and lubricant entrained therein may be conducted through said interior chamber to cool and lubricate said chuck means.

2. The invention set forth in claim 1 wherein:

said means for conducting exhaust air from said exhaust ports comprises a casing disposed around said housing and spaced from said housing to define an expansion chamber for exhaust air exiting from said exhaust ports.

3. The invention set forth in claim 2 wherein:

said inlet ports are in direct communication with said expansion chamber.

4. The invention set forth in claim 3 together with:

a third chamber for receiving exhaust air from said interior chamber by way of said exit ports.

5. The invention set forth in claim 4 wherein:

said third chamber is defined by said housing.

6. The invention set forth in claim 5 wherein:

said drill includes a final exhaust port opening from said third expansion chamber to the exterior of said drill.

* * * * *